US008047169B2

(12) United States Patent
Mashiki et al.

(10) Patent No.: US 8,047,169 B2
(45) Date of Patent: Nov. 1, 2011

(54) VARIABLE VALVE TIMING APPARATUS AND CONTROL METHOD THEREFOR

(75) Inventors: Zenichiro Mashiki, Nisshin (JP); Yasumichi Inoue, Toyota (JP); Noboru Takagi, Toyota (JP); Haruyuki Urushihata, Chiryu (JP)

(73) Assignee: Toyota Jidosha Kabushiki Kaisha, Aichi-Ken (JP)

( * ) Notice: Subject to any disclaimer, the term of this patent is extended or adjusted under 35 U.S.C. 154(b) by 519 days.

(21) Appl. No.: 12/303,341

(22) PCT Filed: Mar. 22, 2007

(86) PCT No.: PCT/JP2007/056761

§ 371 (c)(1),
(2), (4) Date: Dec. 3, 2008

(87) PCT Pub. No.: WO2007/141952

PCT Pub. Date: Dec. 13, 2007

(65) Prior Publication Data

US 2009/0194047 A1 Aug. 6, 2009

(30) Foreign Application Priority Data

Jun. 6, 2006 (JP) ..... 2006-157600

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS

| | | | | |
|---|---|---|---|---|
| 6,032,623 | A | 3/2000 | Yamagishi et al. | |
| 2002/0189563 | A1 * | 12/2002 | Muraki et al. | 123/90.18 |
| 2005/0061276 | A1 | 3/2005 | Ichimura et al. | |
| 2005/0061278 | A1 | 3/2005 | Schafer et al. | |
| 2005/0103298 | A1 | 5/2005 | Schafer et al. | |
| 2006/0124091 | A1 | 6/2006 | Shikata et al. | |
| 2007/0113806 | A1 | 5/2007 | Ezaki et al. | |

FOREIGN PATENT DOCUMENTS

| | | | |
|---|---|---|---|
| EP | 1 426 568 | A1 | 6/2004 |
| JP | 9-256878 | A | 9/1997 |
| JP | 10103029 | A | 4/1998 |
| JP | 11002142 | A | 6/1999 |
| JP | 2004-150397 | A | 5/2004 |

(Continued)

OTHER PUBLICATIONS

Japanese Office Action for corresponding Japanese Patent Application No. 2006-157600 mailed Dec. 21, 2010.

(Continued)

*Primary Examiner* — Zelalem Eshete
(74) *Attorney, Agent, or Firm* — Sughrue Mion, PLLC

(57) ABSTRACT

An ECU executes a program including the steps of: controlling, when the phase of an intake valve is a phase advanced relative to a threshold value CA (FF) (NO in S106), an electric motor operating an intake VVT mechanism by feedback control (S202); and controlling, when the phase of the intake valve is a phase retarded relative to the threshold value CA (FF) (YES in S106), the electric motor by feed-forward control (S200). Under the feed-forward control, a duty command value is output that is smaller than an upper limit of a duty command value under the feedback control.

27 Claims, 11 Drawing Sheets

FOREIGN PATENT DOCUMENTS

| | | | |
|---|---|---|---|
| JP | 2004-257249 | A | 9/2004 |
| JP | 2005-048706 | A | 2/2005 |
| JP | 2005-048707 | A | 2/2005 |
| JP | 2005-098142 | A | 4/2005 |
| JP | 2005-180238 | A | 7/2005 |
| JP | 2005-525495 | A | 8/2005 |
| JP | 2005-532502 | A | 10/2005 |

OTHER PUBLICATIONS

Japanese Office Action dated Jun. 28, 2011, issued in Japanese Patent Application No. 2006-157600 with English translation.

* cited by examiner

VARIABLE VALVE TIMING APPARATUS AND CONTROL METHOD THEREFOR

TECHNICAL FIELD

The present invention relates to a variable valve timing apparatus and a control method therefor. In particular, the invention relates to a variable valve timing apparatus using an actuator operating at a torque according to a command value to change the timing at which a valve is opened/closed, and to a control method therefor.

BACKGROUND ART

VVT (Variable Valve Timing) has conventionally been known that changes the phase (crank angle) in (at) which an intake valve or an exhaust valve is opened/closed, according to an operating condition. Generally, the VVT changes the phase by rotating, relative to a sprocket or the like, a camshaft that causes the intake valve or exhaust valve to open/close. The camshaft is rotated by such an actuator as hydraulic or electric motor. Particularly, in the case where the electric motor is used to rotate the camshaft, the torque for rotating the camshaft is difficult to obtain, as compared with the case where the camshaft is hydraulically rotated. Therefore, in the case where the electric motor is used to rotate the camshaft, the rotational speed of the output shaft of the electric motor is reduced by a speed reducer mechanism or the like, thereby rotating the camshaft. In this case, the degree of phase shift is restricted by the speed reducer mechanism.

Japanese Patent Laying-Open No. 2004-150397 discloses a valve timing adjustment device with a great degree of freedom of phase shift. The valve timing adjustment device disclosed in Japanese Patent Laying-Open No. 2004-150397 is provided to a transmission system for transmitting drive torque from a drive shaft of an internal combustion engine to a driven shaft for opening and closing at least one of an intake valve and an exhaust valve, so as to adjust the timing at which at least one of the intake valve and the exhaust valve is opened and closed. The valve timing adjustment device includes: a first rotator rotated around a rotation centerline by the drive torque from the drive shaft; a second rotator rotated around the rotation centerline together with the rotation of the first rotor and in the same direction as the first rotor so as to rotate the driven shaft synchronously, wherein the second rotor is rotatable relative to the first rotor; and a control device having a control member and varying the radial distance of the control member from the rotation centerline. The first rotor has a first hole forming a first track that extends so as to vary its radial distance from the rotation centerline. The first hole makes contact with the control member that passes through the first track, with the contact between the first hole and the control member occurring at two sides of the first hole toward which the first rotor rotates. The second rotor has a second hole forming a second track extending so as to vary its radial distance from the rotation centerline and making contact with the control member that passes through the second track, with the contact between the second hole and the control member occurring at two sides of the second hole toward which the second rotor rotates. The first track and the second track slant toward each other along the rotational direction of the first rotor and the rotational direction of the second rotor. In this valve timing device, in the case where the electric motor generates no torque, the phase is maintained.

According to the valve timing adjustment device disclosed in this publication, the first hole of the first rotor forms a first track that extends so as to vary its radial distance from the rotation centerline and makes contact with the control member that passes through the first track, with the contact between the first hole and the control member occurring at two sides of the first hole toward which the first rotor rotates. Furthermore, the second hole of the second rotor forms a second track extending so as to vary its radial distance from the rotation centerline and makes contact with the control member that passes through the second track, with the contact between the second hole and the control member occurring at two sides of the second hole toward which the second rotor rotates. Here, the first track and the second track slant toward each other along the rotational direction of the first rotor and the rotational direction of the second rotor. Therefore, when the control device is to change the control member's radial distance from the rotation centerline, the control member presses against at least one of the first hole and the second hole, whereby the control member passes through both the first track and the second track, and thus the second rotor is caused to rotate relative to the first rotor. In the valve timing adjustment device which operates in the foregoing manner, the degree of phase shift of the second rotor with respect to the first rotor is dependent upon the length of the first track and the second track and the degree to which the first track and the second track slant toward each other. By extending the first track and the second track such that they vary their radial distances from the rotation centerline, relative freedom is achieved in determining the length and the mutual slant of the tracks. In turn, this increases freedom in setting the degree of phase shift of the second rotor with respect to the first rotor, and therefore, the degree of phase shift of the driven shaft with respect to the drive shaft.

However, as done by the valve timing adjustment device disclosed in Japanese Patent Laying-Open No. 2004-150397, if an electric motor is used as an actuator, the electric motor has to be controlled in consideration of power consumption and heat generation for example. Further, since the phase for example corresponding to the most retarded angle is determined depending on the mechanical structure of the VVT, the electric motor has to be controlled so as not to damage the VVT. Japanese Patent Laying-Open No. 2004-150397, however, does not include any description concerning control in consideration of these factors.

DISCLOSURE OF THE INVENTION

An object of the present invention is to provide a variable valve timing apparatus and the like that can suppress mechanical breakage, power consumption and heat generation.

A variable valve timing apparatus according to the present invention changes opening and closing timing of at least one of an intake valve and an exhaust valve. The variable valve timing apparatus includes: an actuator operating with a torque that is larger for a larger command value so as to operate the variable valve timing apparatus; and an operation unit. The operation unit controls the command value such that an upper limit of the command value is changed according to an operating state of the variable valve timing apparatus.

In accordance with the variable valve timing apparatus, the actuator operating the variable valve timing apparatus operates with a larger torque as a command value is larger. The command value is controlled by the operation unit. An upper limit of the command value is changed according to an operating state of the variable valve timing apparatus. Thus, by providing a smaller upper limit, excessive torque of the actuator can be restrained. Therefore, the torque of the actuator can be restrained to suppress damage to the VVT due to the operation of the actuator and to suppress power consumption and heat generation of the actuator. Accordingly, the variable valve timing apparatus that can suppress mechanical breakage, power consumption and heat generation can be provided.

Preferably, the operation unit controls the command value in a first control mode, controls the command value in a second control mode in a manner that allows the command value to be larger than the command value controlled in the first control mode, and selects one of the first control mode and the second control mode according to an operating state of the variable valve timing apparatus to change the upper limit of the command value.

In accordance with the variable valve timing apparatus, one of the first control mode and the second control mode is selected according to an operating state of the variable valve timing apparatus so as to change the upper limit of the command value. The second control mode can provide a command value larger than that of the first control mode. Namely, the upper limit of the command value under the first control mode is smaller than the upper limit of the command value under the second control mode. Thus, when the first control mode is selected for example, excessive torque of the actuator can be restrained. Therefore, the torque of the actuator can be restrained to suppress damage to the VVT due to the operation of the actuator and to suppress power consumption and heat generation of the actuator. As a result, mechanical breakage, power consumption and heat generation can be suppressed.

Still preferably, the operation unit selects the first control mode when the opening and closing timing is in a first region, and selects the second control mode when the opening and closing timing is in a second region advanced relative to the first region.

In accordance with the variable valve timing apparatus, in the case where the opening and closing timing is in the first region, first control mode is selected. In the case where the opening and closing timing is in the second region advanced relative to the first region, the second control mode is selected. Accordingly, when the opening and closing timing is to be retarded, a change can be made from the second control mode to the first control mode. Therefore, when the opening and closing timing is to be retarded to the timing of the most retarded angle at which the opening and closing timing cannot be changed due to structural restriction of the variable valve timing apparatus, the torque of the actuator can be suppressed. As a result, damage to the variable valve timing apparatus can be suppressed and power consumption and heat generation when the opening and closing timing is kept at the most retarded angle can be suppressed.

Still preferably, the first control mode is feedback control mode and the second control mode is feedback control mode.

In accordance with the variable valve timing apparatus, the feedback control mode can be used to precisely control the command value.

Still preferably, the first control mode is feed-forward control mode and the second control mode is feed-forward control mode.

In accordance with the variable valve timing apparatus, the feed-forward control mode can be used to precisely control the command value.

Still preferably, the first control mode is feed-forward control mode and the second control mode is feedback control mode.

In accordance with the variable valve timing apparatus, the feed-forward control mode and the feedback control mode can be used to precisely control the command value.

Still preferably, the first control mode is feedback control mode and the second control mode is feed-forward control mode.

In accordance with the variable valve timing apparatus, the feedback control mode and the feed-forward control mode can be used to precisely control the command value.

Still preferably, the variable valve timing apparatus further includes a driver unit driving the actuator so that the actuator operates with a larger torque as the command value is larger. The command value is output from the operation unit to the driver unit.

In accordance with the variable valve timing apparatus, for the variable valve timing apparatus outputting the command value from the operation unit to the driver unit for driving the actuator, mechanical breakage, power consumption and heat generation can be suppressed.

Still preferably, the command value is a voltage.

In accordance with the variable valve timing apparatus, for the variable valve timing apparatus having the actuator operating with a force according to a voltage, mechanical breakage, power consumption and heat generation can be suppressed.

Still preferably, the command value is a current.

In accordance with the variable valve timing apparatus, for the variable valve timing apparatus having the actuator operating with a force according to a current, mechanical breakage, power consumption and heat generation can be suppressed.

BEST MODES FOR CARRYING OUT THE INVENTION

Figure 1:
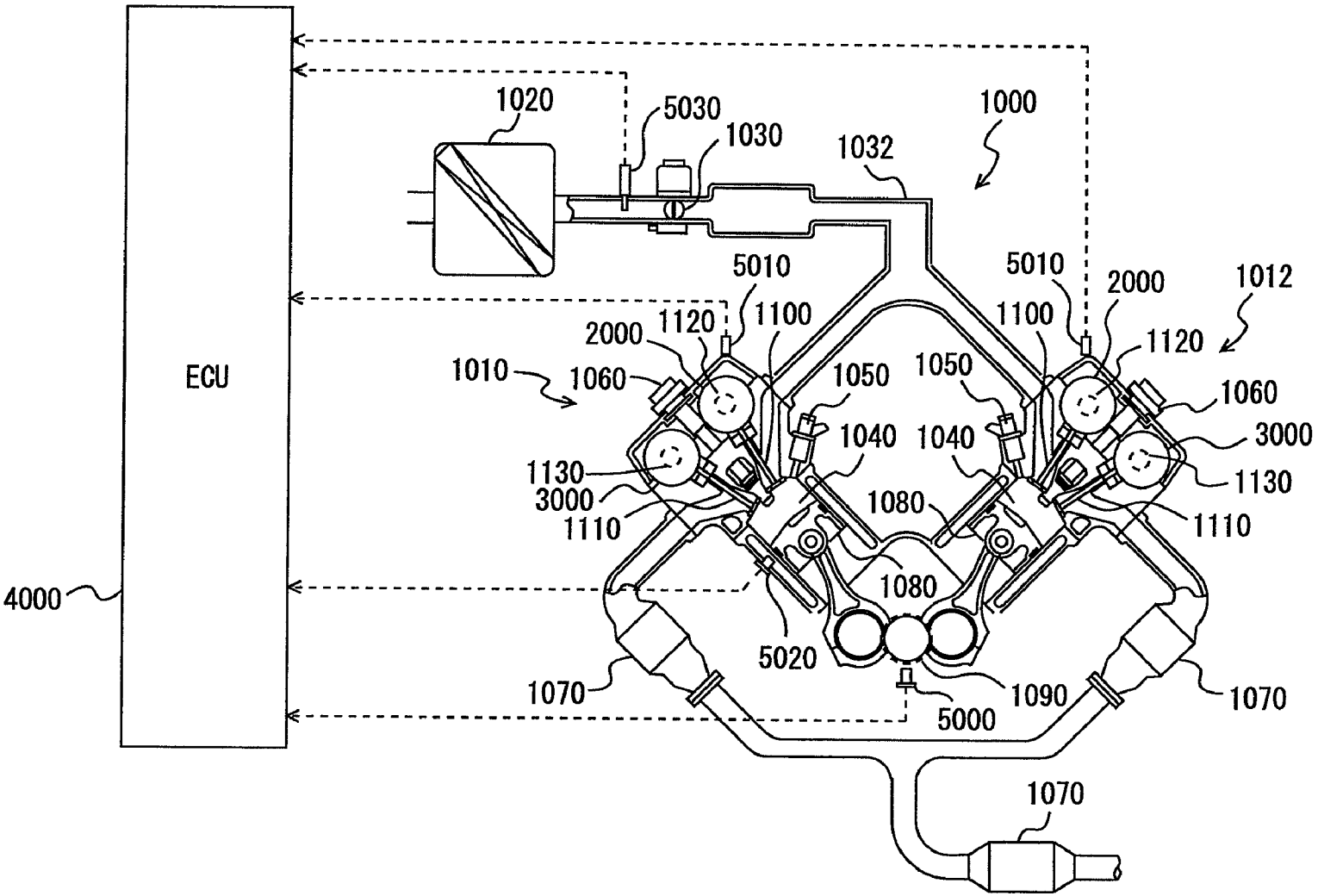
FIG. 1 is a schematic showing a configuration of an engine of a vehicle on which a variable valve timing apparatus is mounted according to an embodiment of the present invention.

With reference to the drawings, embodiments of the present invention are hereinafter described. In the following description, like components are denoted by like reference characters. They are also named identically and function identically. Therefore, a detailed description thereof is not repeated.

Referring to FIG. 1, a description is given of an engine of a vehicle on which a variable valve timing apparatus is mounted, according to an embodiment of the present invention.

Engine 1000 is a V-type 8-cylinder engine having an "A" bank 1010 and a "B" bank 1012 each including a group of four cylinders. Here, any engine other than the V8 engine may be used.

Into engine 1000, air is sucked from an air cleaner 1020. The quantity of sucked air is adjusted by a throttle valve 1030. Throttle valve 1030 is an electronic throttle valve driven by a motor.

The air is supplied through an intake manifold 1032 into a cylinder 1040. The air is mixed with fuel in cylinder 1040 (combustion chamber). Into cylinder 1040, the fuel is directly injected from an injector 1050. In other words, injection holes of injector 1050 are provided within cylinder 1040.

The fuel is injected in the intake stroke. The fuel injection timing is not limited to the intake stroke. Further, in the present embodiment, engine 1000 is described as a direct-injection engine having injection holes of injector 1050 that are disposed within cylinder 1040. However, in addition to direct-injection (in-cylinder) injector 1050, a port injector may be provided. Moreover, only the port injector may be provided.

The air-fuel mixture in cylinder 1040 is ignited by a spark plug 1060 and accordingly burned. The air-fuel mixture after burned, namely exhaust gas, is cleaned by a three-way catalyst 1070 and thereafter discharged to the outside of the vehicle. The air-fuel mixture is burned to press down a piston 1080 and thereby rotate a crankshaft 1090.

At the top of cylinder 1040, an intake valve 1100 and an exhaust valve 1110 are provided. Intake valve 1100 is driven by an intake camshaft 1120. Exhaust valve 1110 is driven by an exhaust camshaft 1130. Intake camshaft 1120 and exhaust camshaft 1130 are coupled by such parts as a chain and gears to be rotated at the same rotational speed.

Intake valve 1100 has its phase (opening/closing timing) controlled by an intake VVT mechanism 2000 provided to intake camshaft 1120. Exhaust valve 1110 has its phase (opening/closing timing) controlled by an exhaust VVT mechanism 3000 provided to exhaust camshaft 1130.

In the present embodiment, intake camshaft 1120 and exhaust camshaft 1130 are rotated by the VVT mechanisms to control respective phases of intake valve 1100 and exhaust valve 1110. Here, the phase control method is not limited to the aforementioned one.

Intake VVT mechanism 2000 is operated by an electric motor 2060 (not shown in FIG. 1). Electric motor 2060 is controlled by an ECU (Electronic Control Unit) 4000. The current and voltage of electric motor 2060 are detected by an ammeter (not shown) and a voltmeter (not shown) and the measurements are input to ECU 4000.

Exhaust VVT mechanism 3000 is hydraulically operated. Here, intake VVT mechanism 2000 may be hydraulically operated while exhaust VVT mechanism 3000 may be operated by an electric motor.

To ECU 4000, signals indicating the rotational speed and the crank angle of crankshaft 1090 are input from a crank angle sensor 5000. Further, to ECU 4000, signals indicating respective phases of intake camshaft 1120 and exhaust camshaft 1130 (signals indicating respective phases of intake valve 1100 and exhaust valve 1110) (phase: the camshaft position in the rotational direction) are input from a cam position sensor 5010. From cam position sensor 5010, signals indicating respective rotational speeds of intake camshaft 1120 and exhaust camshaft 1130 are also input.

Furthermore, to ECU 4000, a signal indicating the water temperature (coolant temperature) of engine 1000 from a coolant temperature sensor 5020 as well as a signal indicating the quantity of intake air (quantity of air taken or sucked into engine 1000) of engine 1000 from an airflow meter 5030 are input.

Moreover, to ECU 4000, a signal indicating the rotational speed of the output shaft of electric motor 2060 is input from a rotational speed sensor 5040.

Based on these signals input from the sensors as well as a map and a program stored in a memory (not shown), ECU 4000 controls the throttle opening position, the ignition timing, the fuel injection timing, the quantity of injected fuel, the phase of intake valve 1100 and the phase of exhaust valve 1110 for example, so that engine 1000 is operated in a desired operating state.

Figure 2:
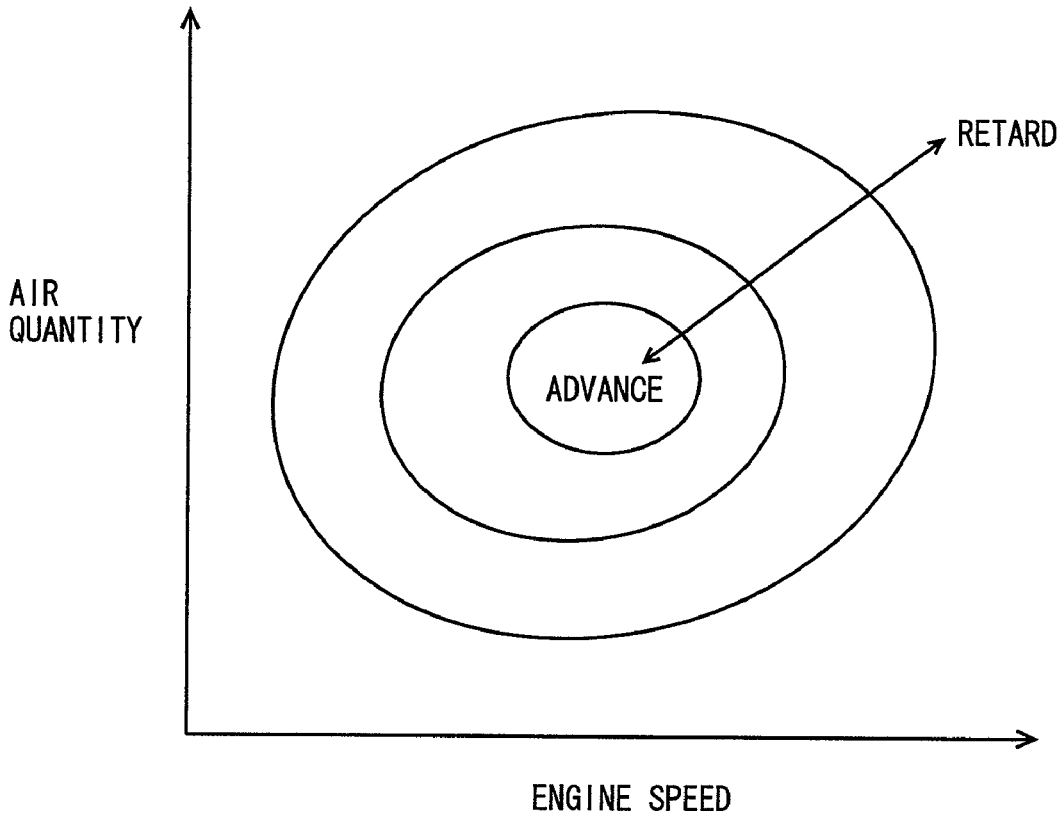
FIG. 2 shows a map defining the phase of an intake valve.

In the present embodiment, ECU 4000 determines the phase of intake valve 1100 based on the map as shown in FIG. 2 that uses the engine speed NE and the intake air quantity KL as parameters. A plurality of maps for respective coolant temperatures are stored for determining the phase of intake valve 1100.

In the following, a further description is given of intake VVT mechanism 2000. Here, exhaust VVT mechanism 3000 may be configured identically to intake VVT mechanism 2000 as described below.

Figure 3:
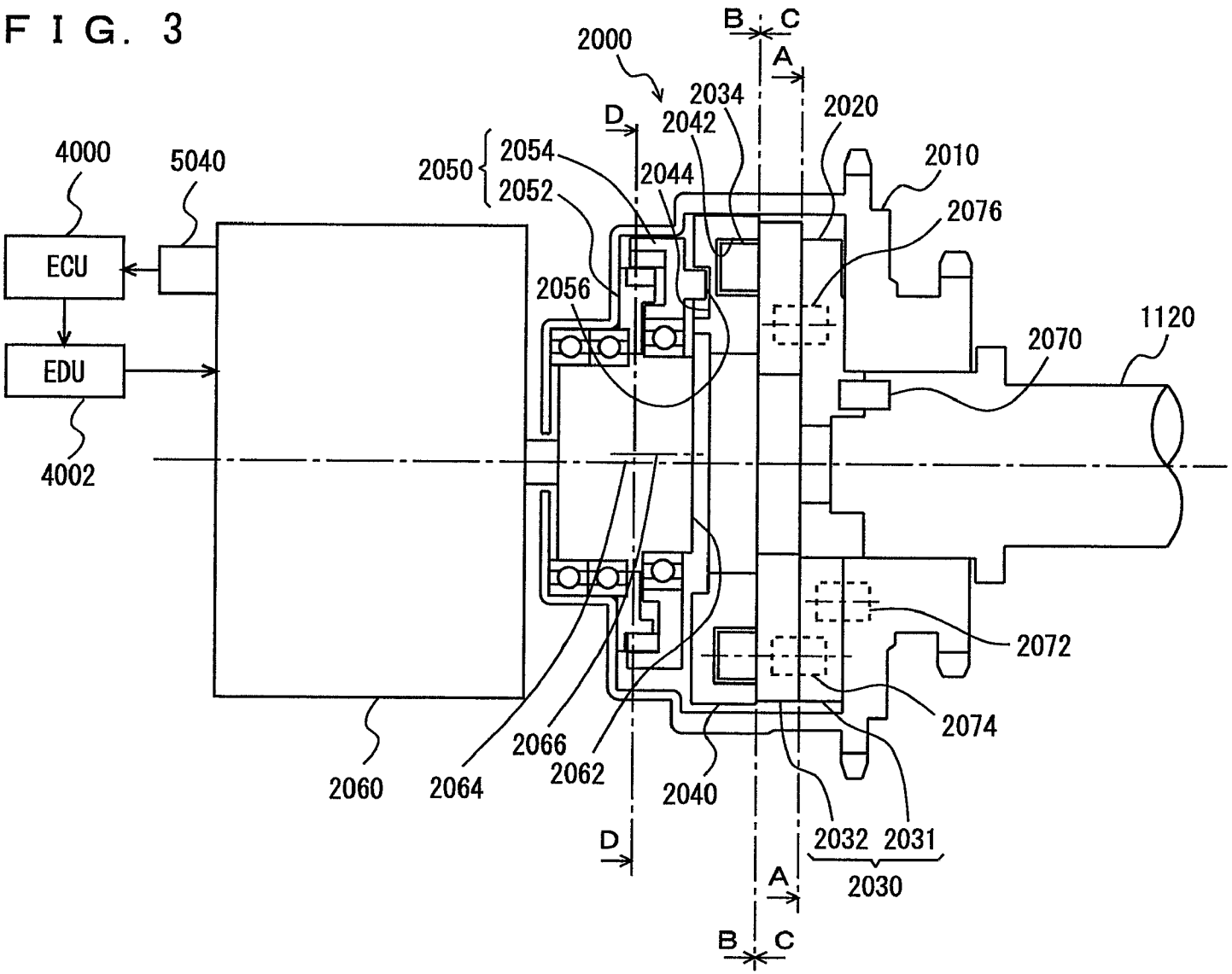
FIG. 3 is a cross section showing an intake VVT mechanism.

As shown in FIG. 3, intake VVT mechanism 2000 is comprised of a sprocket 2010, a cam plate 2020, a link mechanism 2030, a guide plate 2040, a speed reducer 2050, and electric motor 2060.

Sprocket 2010 is coupled via a chain or the like to crankshaft 1090. The rotational speed of sprocket 2010 is half the rotational speed of crankshaft 1090. Intake camshaft 1120 is provided concentrically with the rotational axis of sprocket 2010 and rotatably relative to sprocket 2010.

Cam plate 2020 is coupled to intake camshaft 1120 with a pin (1) 2070. Cam plate 2020 rotates, on the inside of sprocket 2010, together with intake camshaft 1120. Here, cam plate 2020 and intake camshaft 1120 may be integrated into one unit.

Figure 4:
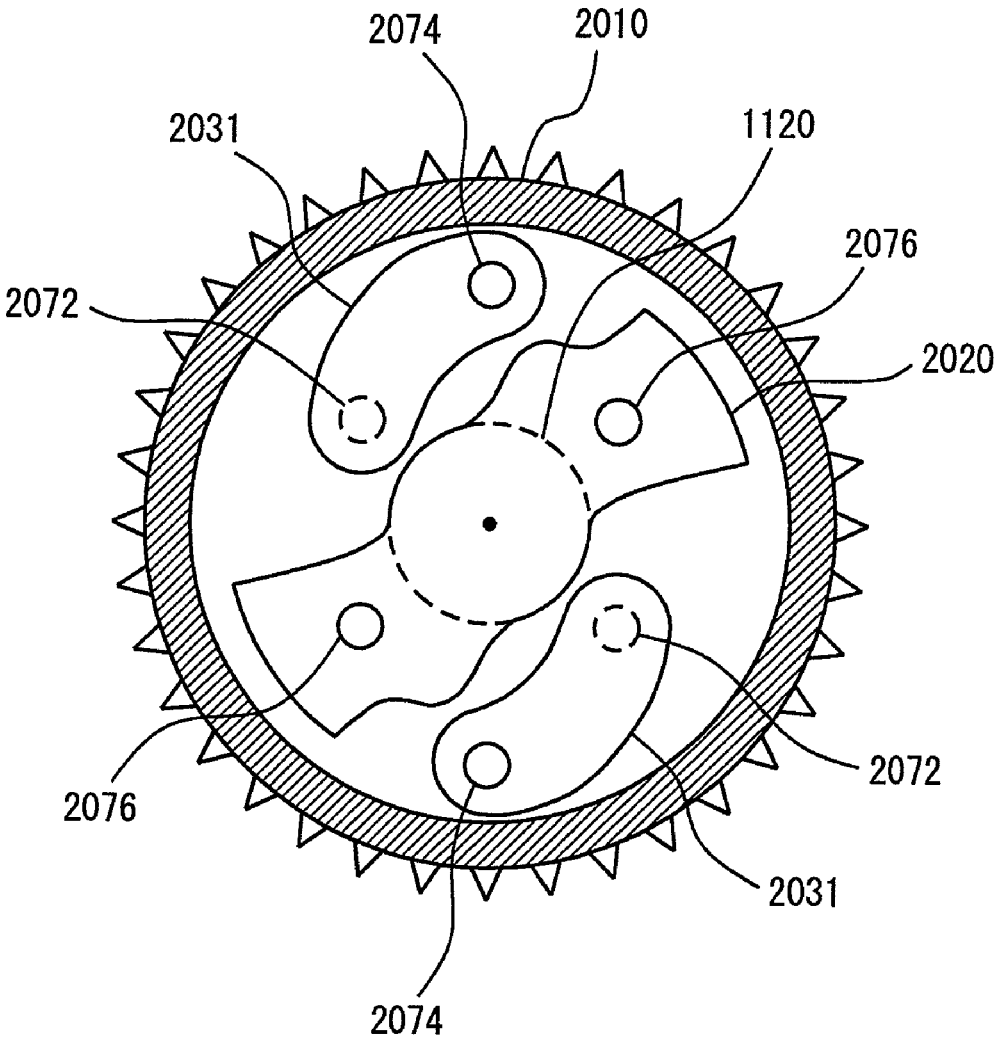
FIG. 4 is a cross section along A-A in FIG. 3.

Link mechanism 2030 is comprised of an arm (1) 2031 and an arm (2) 2032. As shown in FIG. 4 which is a cross section along A-A in FIG. 3, a pair of arms (1) 2031 is provided within sprocket 2010 so that the arms are point symmetric to each other with respect to the rotational axis of intake camshaft 1120. Each arm (1) 2031 is coupled to sprocket 2010 so that the arm can swing about a pin (2) 2072.

Figure 5:
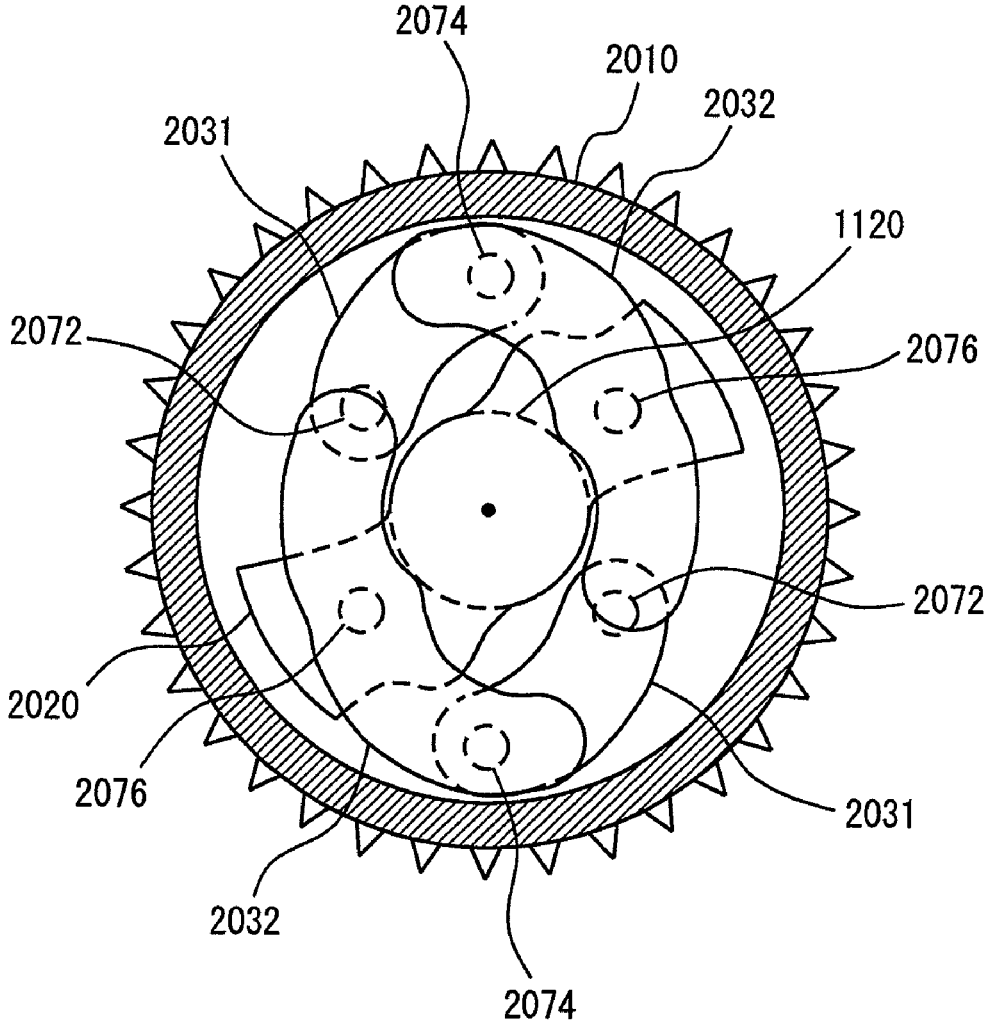
FIG. 5 is a (first) cross section along B-B in FIG. 3.
Figure 6:
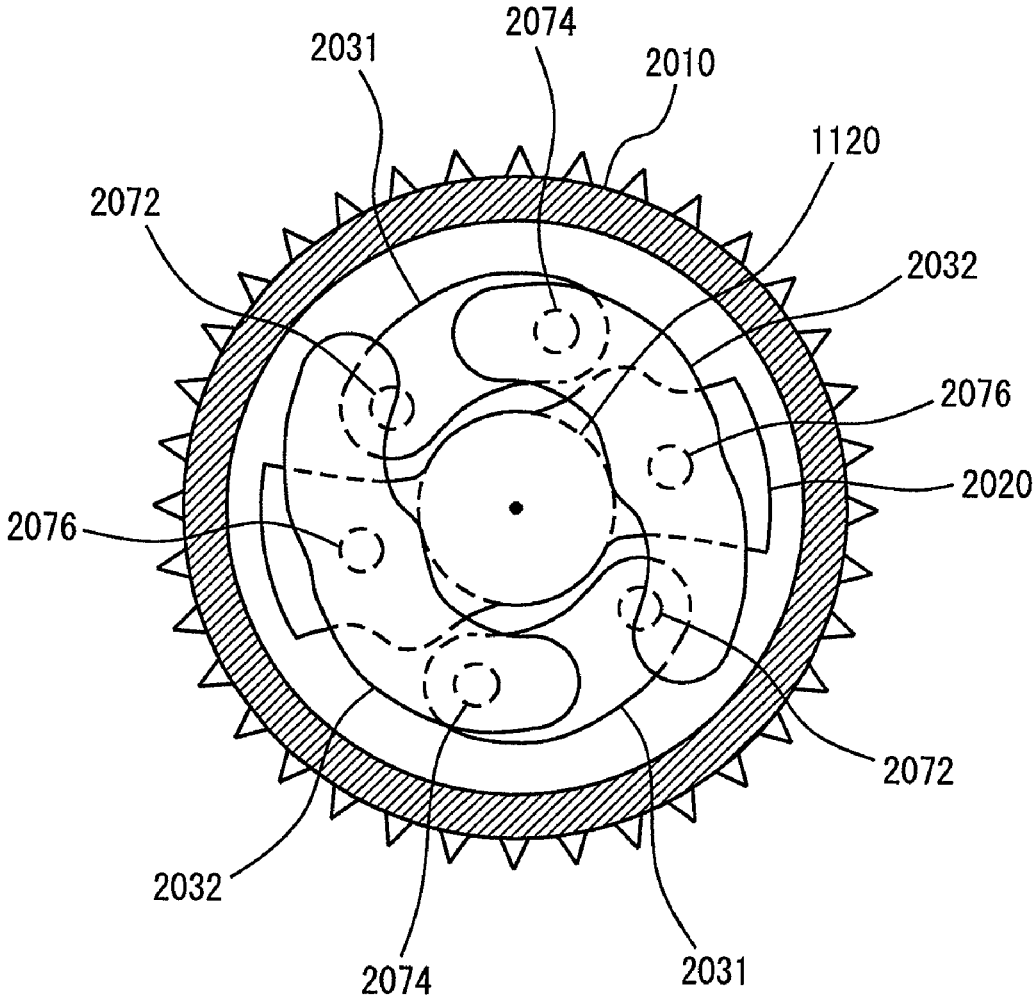
FIG. 6 is a (second) cross section along B-B in FIG. 3.

As shown in FIG. 5 which is a cross section along B-B in FIG. 3 and as shown in FIG. 6 showing the state where the phase of intake valve 1100 is advanced with respect to the state in FIG. 5, arms (1) 2031 and cam plate 2020 are coupled by arms (2) 2032.

Arm (2) 2032 is supported so that the arm can swing about a pin (3) 2074 and with respect to arm (1) 2031. Further, arm (2) 2032 is supported so that the arm can swing about a pin (4) 2076 and with respect to cam plate 2020.

A pair of link mechanisms 2030 causes intake camshaft 1120 to rotate relative to sprocket 2010 and thereby changes the phase of intake valve 1100. Thus, even if one of the paired link mechanisms 2030 is broken as a result of any damage or the like, the other link mechanism can be used to change the phase of intake valve 1100.

Referring back to FIG. 3, at a surface of each link mechanism 2030 (arm (2) 2032) that is a surface thereof facing guide plate 2040, a control pin 2034 is provided. Control pin 2034 is provided concentrically with pin (3) 2074. Each control pin 2034 slides in a guide groove 2042 provided in guide plate 2040.

Each control pin 2034 slides in guide groove 2042 of guide plate 2040 to shift in the radial direction. The radial shift of each control pin 2034 causes intake camshaft 1120 to rotate relative to sprocket 2010.

Figure 7:
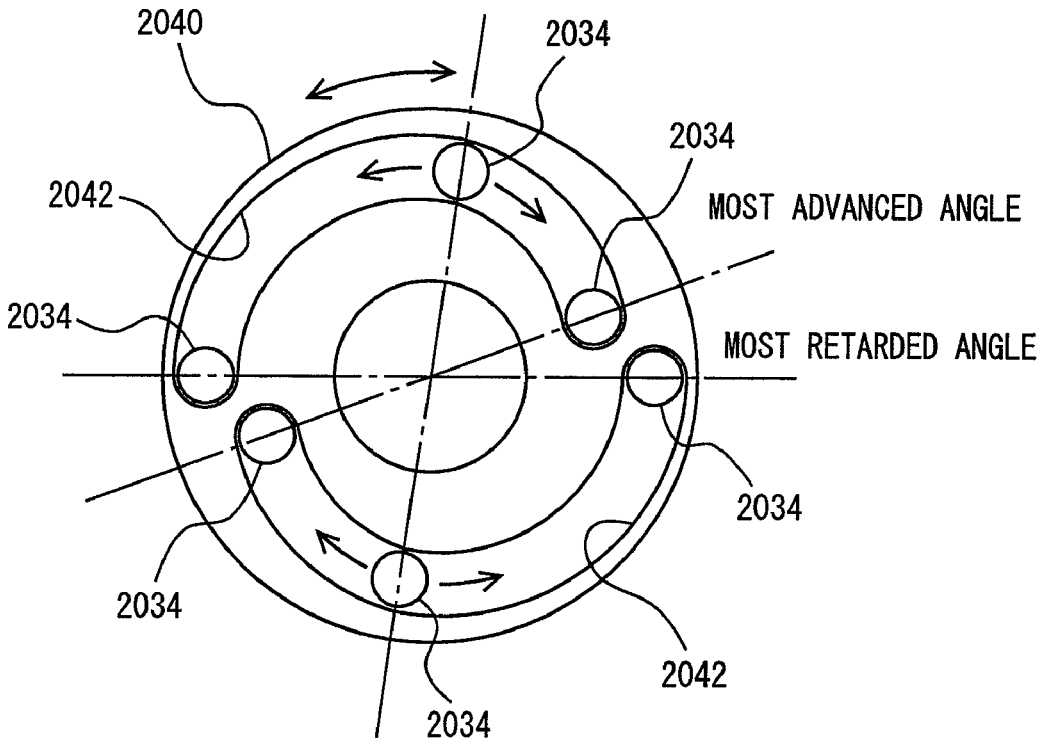
FIG. 7 is a cross section along C-C in FIG. 3.

As shown in FIG. 7 which is a cross section along C-C in FIG. 3, guide groove 2042 is formed in the spiral shape so that rotation of guide plate 2040 causes each control pin 2034 to shift in the radial direction. Here, the shape of guide groove 2042 is not limited to this.

As control pin 2034 is shifted further in the radial direction from the axial center of guide plate 2040, the phase of intake valve 1100 is retarded to a greater extent. In other words, the variation amount of the phase has a value corresponding to the operation amount of link mechanism 2030 generated by the radial shift of control pin 2034. Alternatively, the phase of intake valve 1100 may be advanced to a greater extent as control pin 2034 is shifted further in the radial direction from the axial center of guide plate 2040.

As shown in FIG. 7, when control pin 2034 abuts on an end of guide groove 2042, the operation of link mechanism 2030 is restrained. Therefore, the phase in which control pin 2034 abuts on an end of guide groove 2042 is the phase of the most retarded angle or the most advanced angle.

Referring back to FIG. 3, in guide plate 2040, a plurality of depressed portions 2044 are provided in its surface facing speed reducer 2050, for coupling guide plate 2040 and speed reducer 2050 to each other.

Speed reducer 2050 is comprised of an outer teeth gear 2052 and an inner teeth gear 2054. Outer teeth gear 2052 is fixed with respect to sprocket 2010 so that the gear rotates together with sprocket 2010.

Inner teeth gear 2054 has a plurality of protruded portions 2056 thereon that are received in depressed portions 2044 of guide plate 2040. Inner teeth gear 2054 is supported rotatably about an eccentric axis 2066 of a coupling 2062 formed eccentrically with respect to an axial center 2064 of an output shaft of electric motor 2060.

Figure 8:
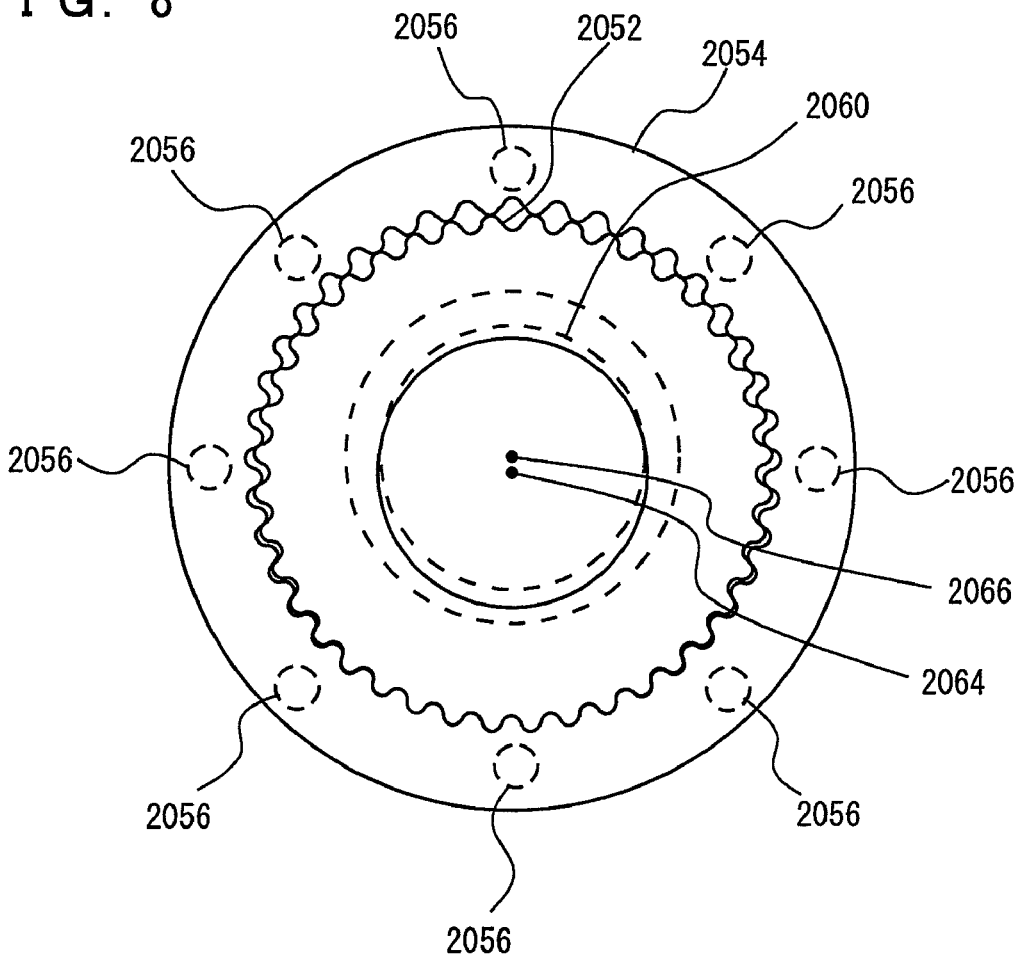
FIG. 8 is a cross section along D-D in FIG. 3.

FIG. 8 shows a cross section along D-D in FIG. 3. Inner teeth gear 2054 is provided so that a part of the teeth thereof meshes with outer teeth gear 2052. In the case where the rotational speed of the output shaft of electric motor 2060 is identical to the rotational speed of sprocket 2010, coupling 2062 and inner teeth gear 2054 rotate at the same rotational speed as that of outer teeth gear 2052 (sprocket 2010). In this case, guide plate 2040 rotates at the same rotational speed as that of sprocket 2010 and accordingly the phase of intake valve 1100 is maintained.

When electric motor 2060 causes coupling 2062 to rotate about axial center 2064 and relative to outer teeth gear 2052, accordingly inner teeth gear 2054 as a whole revolves about axial center 2064 while inner teeth gear 2054 rotates about eccentric axis 2066. The rotational motion of inner teeth gear 2054 causes guide plate 2040 to rotate relative to sprocket 2010 and thus the phase of intake valve 1100 is changed.

The phase of intake valve 1100 is changed by reduction of the rotational speed of relative rotation between the output shaft of electric motor 2060 and sprocket 2010 (operation amount of electric motor 2060) by speed reducer 2050, guide plate 2040 and link mechanism 2030. Here, the rotational speed of relative rotation between the output shaft of electric motor 2060 and sprocket 2010 may be increased to change the phase of intake valve 1100.

Figure 9:
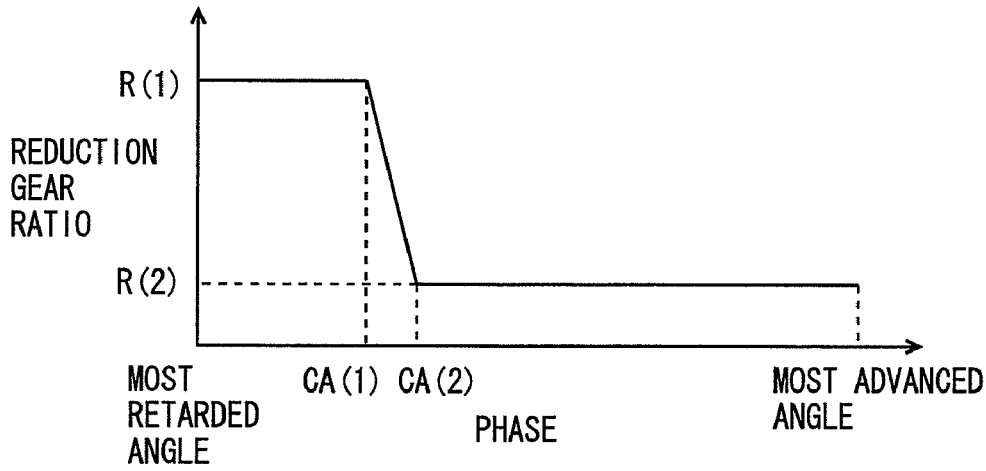
FIG. 9 shows the reduction gear ratio of the intake VVT mechanism as a whole.

As shown in FIG. 9, the reduction gear ratio of intake VVT mechanism 2000 as a whole (the ratio of the rotational speed of relative rotation between the output shaft of electric motor 2060 and sprocket 2010 to the variation amount of the phase) may have a value according to the phase of intake valve 1100. In the present embodiment, as the reduction gear ratio is higher, the variation amount of the phase with respect to the rotational speed of relative rotation between the output shaft of electric motor 2060 and sprocket 2010 is smaller.

In the case where the phase of intake valve 1100 is in a retard region from the most retarded angle to CA (1), the reduction gear ratio of intake VVT mechanism 2000 as a whole is R (1). In the case where the phase of intake valve 1100 is in an advance region from CA (2) (CA (2) is advanced with respect to CA (1)) to the most advanced angle, the reduction gear ratio of intake VVT mechanism 2000 as a whole is R (2) (R (1)>R (2)).

In the case where the phase of intake valve 1100 is in an intermediate region from CA (1) to CA (2), the reduction gear ratio of intake VVT mechanism 2000 as a whole changes at a predetermined rate of change ((R (2)−R (1))/(CA (2)−CA (1)).

In the following, operation of intake VVT mechanism 2000 of the variable valve timing apparatus is described.

Figure 10:
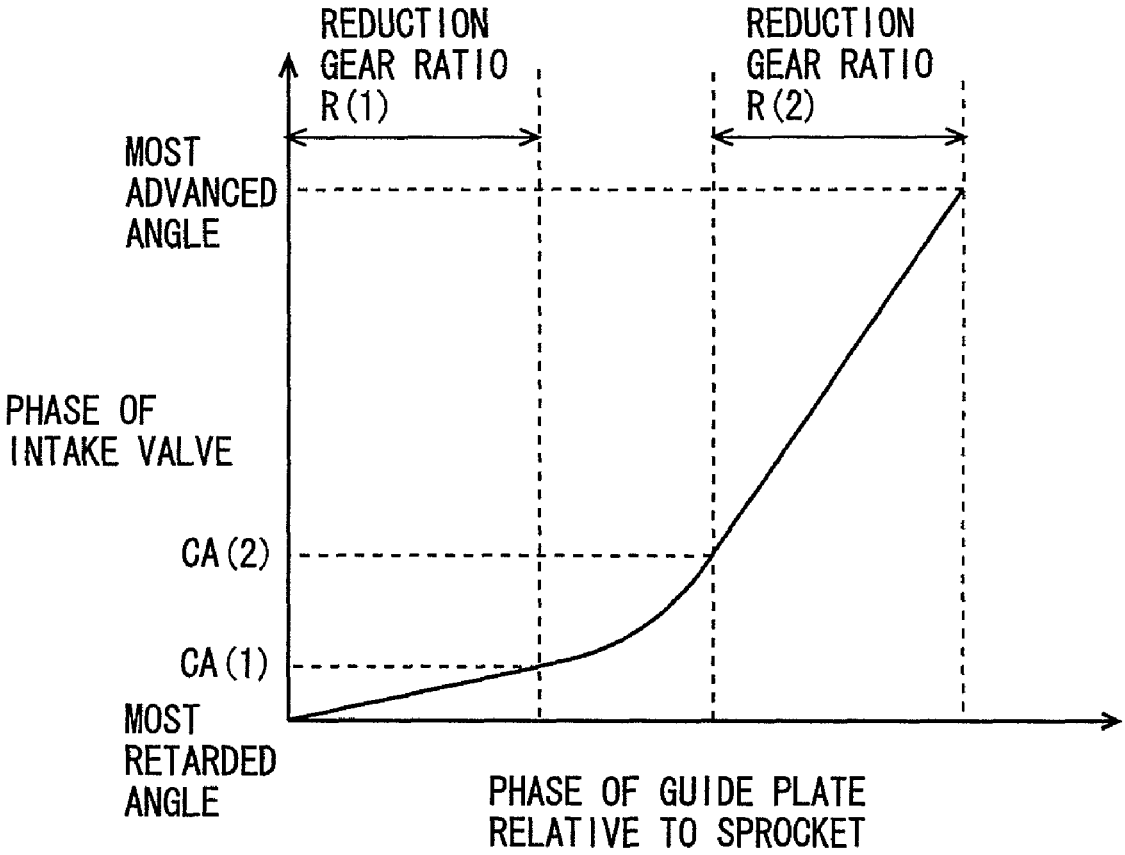
FIG. 10 shows a relation between the phase of a guide plate relative to a sprocket and the phase of an intake valve.

In the case where the phase of intake valve 1100 (intake camshaft 1120) is to be advanced, electric motor 2060 is operated to rotate guide plate 2040 relative to sprocket 2010, thereby advancing the phase of intake valve 1100 as shown in FIG. 10.

In the case where the phase of intake valve 1100 is in the retard region between the most retarded angle and CA (1), the rotational speed of relative rotation between the output shaft of electric motor 2060 and sprocket 2010 is reduced at reduction gear ratio R (1) to advance the phase of intake valve 1100.

In the case where the phase of intake valve 1100 is in the advance region between CA (2) and the most advanced angle, the rotational speed of relative rotation between the output shaft of electric motor 2060 and sprocket 2010 is reduced at reduction gear ratio R (2) to advance the phase of intake valve 1100.

In the case where the phase of intake valve 1100 is to be retarded, the output shaft of electric motor 2060 is rotated relative to sprocket 2010 in the direction opposite to the direction in the case where the phase thereof is to be advanced. In the case where the phase is to be retarded, similarly to the case where the phase is to be advanced, when the phase of intake valve 1100 is in the retard region between the most retarded angle and CA (1), the rotational speed of relative rotation between the output shaft of electric motor 2060 and sprocket 2010 is reduced at reduction gear ratio R (1) to retard the phase. Further, when the phase of intake valve 1100 is in the advance region between CA (2) and the most advanced angle, the rotational speed of relative rotation between the output shaft of electric motor 2060 and sprocket 2010 is reduced at reduction gear ratio R (2) to retard the phase.

Accordingly, as long as the direction of the relative rotation between the output shaft of electric motor 2060 and sprocket 2010 is the same, the phase of intake valve 1100 can be advanced or retarded for both of the retard region between the most retarded angle and CA (1) and the advance region between CA (2) and the most advanced angle. Here, for the advance region between CA (2) and the most advanced angle, the phase can be more advanced or more retarded. Thus, the phase can be changed over a wide range.

Further, since the reduction gear ratio is high for the retard region between the most retarded angle and CA (1), a large torque is necessary for rotating the output shaft of electric motor 2060 by a torque acting on intake camshaft 1120 as engine 1000 operates. Therefore, in the case where electric motor 2060 is stopped for example, even if electric motor 2060 generates no torque, rotation can be restrained of the output shaft of electric motor 2060 caused by the torque acting on intake camshaft 1120. Therefore, a change of the actual phase from a phase determined under control can be restrained.

In the case where the phase of intake valve 1100 is in the intermediate region between CA (1) and CA (2), the rotational speed of relative rotation between the output shaft of electric motor 2060 and sprocket 2010 is reduced at a reduction gear ratio that changes at a predetermined rate of change, which may result in advance or retard in phase of intake valve 1100.

Accordingly, in the case where the phase changes from the retard region to the advance region or from the advance region to the retard region, the variation amount of the phase with respect to the rotational speed of relative rotation between the output shaft of electric motor 2060 and sprocket 2010 can be increased or decreased gradually. In this way, a sudden stepwise change of the variation amount of the phase can be restrained to thereby restrain a sudden change in phase. Accordingly, the capability to control the phase can be improved.

Referring again back to FIG. 3, electric motor 2060 is duty-controlled by ECU 4000 through an EDU (Electronic Driver Unit) 4002. Here, "duty control" refers to control of the operating voltage of electric motor 2060 by setting the duty ratio that is the ratio of an ON period of a switching element (not shown) of EDU 4002 and thereby operating the switching element at this duty ratio.

In other words, the operating voltage of electric motor 2060 is a voltage determined according to the duty ratio. As the duty ratio is higher, the operating voltage is higher. As the operating voltage is higher, a larger torque is generated by electric motor 2060. Further, as operating current is higher, electric motor 2060 generates a larger torque.

A signal indicating a duty ratio that is set by ECU 4000 is output to EDU 4002. EDU 4002 then outputs a voltage according to the duty ratio and accordingly electric motor 2060 is driven.

Instead of setting the duty ratio, the operating voltage or operating current of electric motor 2060 may be set directly. In this case, the set operating voltage or operating current may be used to drive electric motor 2060.

The rotational speed of electric motor 2060 is a rotational speed determined according to a torque generated by electric motor 2060. The rotational speed of electric motor 2060 is detected by rotational speed sensor 5040 and a signal indicating the result of the detection is transmitted to ECU 4000.

Figure 11:
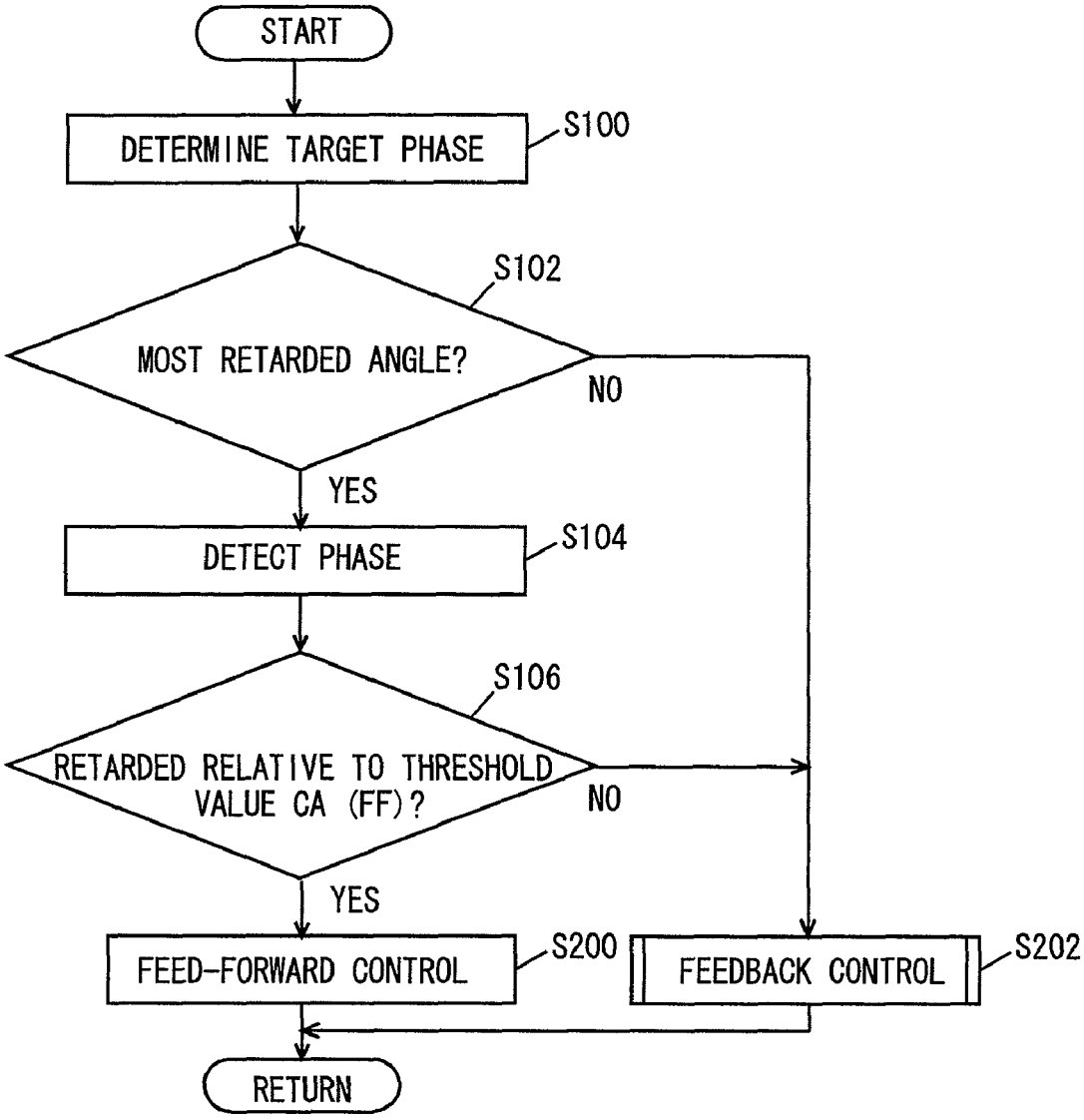
FIG. 11 is a (first) flowchart showing a control structure of a program executed by an ECU in FIG. 1.

Referring to FIG. 11, a description is given of a control structure of a program executed by ECU 4000 controlling the variable valve timing apparatus according to the present embodiment. The program described below is repeatedly executed in cycles with a predetermined period.

In step (hereinafter abbreviated as S) 100, ECU 4000 uses the map shown in FIG. 2 as described above to determine a target phase of intake valve 1100 based on engine speed NE and intake air quantity KL.

In S102, ECU 4000 determines whether or not the determined target phase is the phase retarded to the maximum extent (hereinafter also referred to as most retarded phase) among phases that can be implemented by intake VVT mechanism 2000. When the target phase is the most retarded phase (YES in S102), this process proceeds to S104. Otherwise (NO in S102), the process proceeds to S202.

In S104, ECU 4000 detects the phase of intake camshaft 1120, namely the phase of intake valve 1100 based on a signal transmitted from cam position sensor 5010.

In S106, ECU 4000 determines whether or not the phase of intake valve 1100 is a phase retarded relative to threshold value CA (FF). When the phase of intake valve 1100 is the phase retarded relative to threshold value CA (FF) (YES in S106), the process proceeds to S200. Otherwise (NO in S106), the process proceeds to S202.

In S200, ECU 4000 controls electric motor 2060 by feed-forward control. Under the feed-forward control, a predetermined duty command value (duty ratio commanded EDU 4002 to have) is transmitted to EDU 4002.

In the present embodiment, the duty command value transmitted to EDU 4002 under the feed-forward control is set to a value that does not cause intake VVT mechanism 2000 to be damaged when control pin 2034 abuts on an end of guide groove 2042 of intake VVT mechanism 2000 as shown in FIG. 7 described above. The duty command value is set in advance through an experiment, simulation or the like.

In S202, ECU 4000 controls electric motor 2060 by feedback control.

Figure 12:
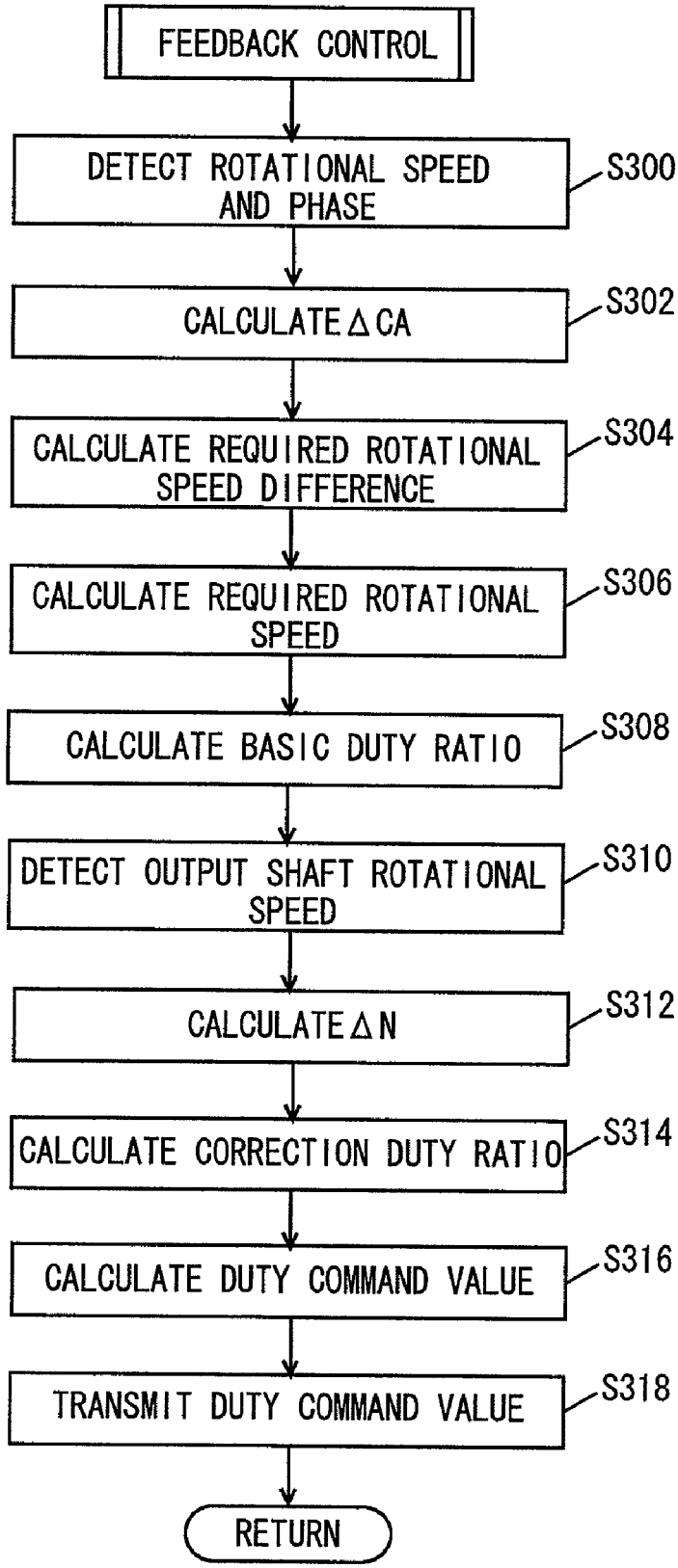
FIG. 12 is a (second) flowchart showing a control structure of a program executed by the ECU in FIG. 1.

Referring to FIG. 12, a description is given of a control structure of a program executed by ECU 4000 when ECU 4000 controls electric motor 2060 by the feedback control. The program is repeatedly executed in cycles with a predetermined period.

In S300, ECU 4000 detects, based on a signal transmitted from cam position sensor 5010, the rotational speed and the phase of intake camshaft 1120 (phase of intake valve 1100). In S302, ECU 4000 calculates difference ΔCA between the target phase and the detected phase.

In S304, ECU 4000 calculates, based on difference ΔCA between the target phase and the detected phase, a required value of the rotational speed difference between the output shaft of electric motor 2060 and sprocket 2010 (rotational speed of the relative rotation between the output shaft and the sprocket) (this required value is hereinafter also referred to as required rotational speed difference). The required rotational speed difference is calculated, for example, using a map prepared with ΔCA as a parameter. The method of calculating the required rotational speed difference is not limited to the above-described one.

In S306, ECU 4000 calculates a required value of the rotational speed (hereinafter also referred to as required rotational speed) of the output shaft of electric motor 2060. The required rotational speed is calculated by determining the sum of the required rotational speed difference calculated in S304 and the rotational speed of intake camshaft 1120.

In S308, ECU 4000 calculates a basic duty ratio of electric motor 2060 based on the required rotational speed. The basic duty ratio is calculated so that the calculated basic duty ratio has a larger value as the required rotational speed is higher. The basic duty ratio is calculated using, for example, a map prepared with the required rotational speed as a parameter. The method of calculating the basic duty ratio is not limited to the above-described one.

In S310, ECU 4000 detects the rotational speed of the output shaft of electric motor 2060 based on a signal transmitted from rotational speed sensor 5040. In S312, ECU 4000 calculates rotational speed difference ΔN between the required rotational speed and the detected rotational speed of the output shaft.

In S314, ECU 4000 calculates a correction duty ratio of electric motor 2060 based on rotational speed difference ΔN between the required rotational speed and the detected rotational speed of the output shaft. The correction duty ratio is calculated by multiplying the rotational speed difference by correction factor K for example. The method of calculating the correction duty ratio is not limited to the above-described one.

In S316, ECU 4000 calculates the duty command value for electric motor 2060 by calculating the sum of the basic duty ratio and the correction duty ratio. This duty command value may have a larger value than the duty command value in S200 described above. In other words, this duty command value has a higher upper limit.

In S318, ECU 4000 transmits the duty command value to EDU 4002. Namely, electric motor 2060 is operated at a voltage determined according to the duty command value.

Based on the structure and the flowchart as described above, operation of the variable valve timing apparatus is described according to the present embodiment.

While engine 1000 is operated, the map shown in FIG. 2 as described above is used to determine a target phase of intake valve 1100 based on engine rotational speed NE and intake air quantity KL (S100). When the determined target phase is not the most retarded phase (NO in S102), electric motor 2060 is controlled by the feedback control (S202) and accordingly the phase of intake valve 1100 is controlled.

Specifically, based on a signal transmitted from cam position sensor 5010, the rotational speed and the phase of intake camshaft 1120 (phase of intake valve 1100) are detected (S300).

Difference ΔCA between the target phase and the detected phase is calculated (S302). Based on ΔCA, a required rotational speed difference between the output shaft of electric motor 2060 and sprocket 2010 is calculated (S304).

The sum of the required rotational speed difference and the rotational speed of intake camshaft 1120 is determined to calculate the required rotational speed of the output shaft of electric motor (S306). Based on the required rotational speed, the basic duty ratio of electric motor 2060 is calculated (S308).

Further, based on a signal transmitted from rotational speed sensor 5040, the output shaft rotational speed of electric motor 2060 is detected (S310) and rotational speed difference ΔN between the required rotational speed and the detected output shaft rotational speed is calculated (S312). Based on this rotational speed difference ΔN, the correction duty ratio of electric motor 2060 is calculated (S314), and the sum of the basic duty ratio and the correction duty ratio is determined to calculate the duty command value for electric motor 2060 (S316).

The duty command value thus calculated is transmitted to EDU 4002 (S318). Accordingly, electric motor 2060 is operated at a voltage determined according to the duty command value. Therefore, by means of the feedback control, the phase of intake valve 1100 can be controlled accurately.

When the determined target phase is the most retarded phase (YES in S102) and the phase of intake valve 1100 is a phase advanced relative to threshold value CA (FF) (NO in S106), the feedback control is used to control the phase of intake valve 1100, namely control the duty command value as done in the case where the determined target phase is not the most retarded phase (NO in S102).

In contrast, when the determined target phase is the most retarded phase (YES in S102) and the phase of intake valve 1100 is a phase retarded relative to threshold value CA (FF) (YES in S106), the phase control by the feedback control is not necessarily preferred.

Specifically, in the case where the duty command value determined by the feedback control is used to operate electric motor 2060, the output torque of electric motor 2060 could be excessive to cause, when control pin 2034 of intake VVT mechanism 2000 abuts on an end of guide groove 2042, intake VVT mechanism 2000 to be damaged.

Accordingly, when the determined target phase is the most retarded phase (YES in S102) and the phase of intake valve 1100 is a phase retarded relative to threshold value CA (FF) (YES in S106), electric motor 2060 is controlled by the feed-forward control (S200) instead of the feedback control so as to control the phase.

Specifically, a duty command value set in advance to a value that does not cause intake VVT mechanism 2000 to be damaged is transmitted to EDU 4002. In other words, to EDU 4002, a duty command value is transmitted that is smaller than the upper limit of a duty command value which is determined in the case where intake valve 1100 has the phase advanced relative to threshold value CA (FF).

Thus, an impact that could occur when control pin 2034 of intake VVT mechanism 2000 abuts on an end of guide groove 2042 can be suppressed. Further, when the phase is kept in the most retarded phase, the power consumption and heat generation of electric motor 2060 can be suppressed.

As described above, according to the variable valve timing apparatus of the present embodiment, a duty command value transmitted to the EDU when a detected phase is a retarded phase relative to threshold value CA (FF) is smaller than the upper limit of a duty command value determined in the case where a detected phase is an advanced phase relative to threshold value CA (FF). Thus, an impact that could occur when the control pin of the intake VVT mechanism abuts on an end of the guide groove can be suppressed. Further, when the phase is kept in the most retarded phase, power consumption and heat generation of the electric motor can be suppressed. Therefore, damage to the intake VVT mechanism as well as the power consumption and heat generation of the electric motor can be suppressed.

Instead of setting a duty command value, in the case where a detected phase is a retarded phase relative to threshold value CA (FF), to a value smaller than the upper limit of a duty command value that is set in the case where a detected phase is an advanced phase relative to threshold value CA (FF), a duty command value that is set when a predetermined condition is satisfied may be set smaller than the upper limit of a duty command value that is set when the condition is not satisfied.

Further, the duty command value determined in the case where a detected phase is a retarded phase relative to threshold value CA (FF) may be changed according to the phase of intake valve 1100. In this case, the upper limit of a duty command value determined in the case where a detected phase is a retarded phase relative to threshold value CA (FF) may be set smaller than the upper limit of a duty command value determined in the case where a detected phase is an advanced phase relative to threshold value CA (FF).

Other Embodiments

In both of the cases where a detected phase is a retarded phase relative to the threshold value and where a detected phase is an advanced phase relative to the threshold value, the phase namely the duty command value may be controlled by the feed-forward control so that the upper limit of a duty command value determined in the case where a detected phase is a retarded phase relative to the threshold value is smaller than the upper limit of a duty command value determined in the case where a detected phase is an advanced phase relative to the threshold value.

Alternatively, in both of the cases where a detected phase is a retarded phase relative to the threshold value and where a detected phase is an advanced phase relative to the threshold value, the phase may be controlled by the feedback control so that the upper limit of a duty command value determined in the case where a detected phase is a retarded phase relative to the threshold value is smaller than the upper limit of a duty command value determined in the case where a detected phase is an advanced phase relative to the threshold value.

Further, the phase may be controlled by the feed back control in the case where a detected phase is a retarded phase relative to the threshold value and the phase may be controlled by the feed-forward control in the case where a detected phase is an advanced phase relative to the threshold value so that the upper limit of a duty command value determined in the case where a detected phase is a retarded phase relative to the threshold value is smaller than the upper limit of a duty command value determined in the case where a detected phase is an advanced phase relative to the threshold value.

It should be noted that the embodiments disclosed herein should be understood as being illustrative rather than limitative in all respects. The scope of the present invention is defined by the appended claims rather than by the foregoing description and all changes which come within the meaning and range of equivalency of the claims are therefore intended to be embraced therein.

The invention claimed is:

1. A variable valve timing apparatus changing opening and closing timing of at least one (1100, 1110) of an intake valve (1100) and an exhaust valve (1110), comprising:

an actuator (2060) operating with a torque that is larger for a larger command value so as to operate said variable valve timing apparatus; and an operation unit (4000), said operation unit (4000) controlling said command value in a first control mode, said operation unit (4000) controlling said command value in a second control mode in a manner that allows said command value to be larger than said command value controlled in said first control mode, and said operation unit (4000) selecting said first control mode when said opening and closing timing is in a first region, and selecting said second control mode when said opening and closing timing is in a second region different from said first region.

2. The variable valve timing apparatus according to claim 1, wherein said second region is advanced relative to said first region.

3. The variable valve timing apparatus according to claim 1, wherein said first control mode is feedback control mode, and said second control mode is feedback control mode.

4. The variable valve timing apparatus according to claim 1, wherein said first control mode is feed-forward control mode, and said second control mode is feed-forward control mode.

5. The variable valve timing apparatus according to claim 1, wherein said first control mode is feed-forward control mode, and said second control mode is feedback control mode.

6. The variable valve timing apparatus according to claim 1, wherein said first control mode is feedback control mode, and said second control mode is feed-forward control mode.

7. The variable valve timing apparatus according to claim 1, further comprising a driver unit (4002) driving said actuator (2060) so that said actuator (2060) operates with a larger torque as said command value is larger, and said command value is output from said operation unit (4000) to said driver unit (4002).

8. The variable valve timing apparatus according to claim 1, wherein said command value is a voltage.

9. The variable valve timing apparatus according to claim 1, wherein said command value is a current.

10. A control method of controlling a variable valve timing apparatus changing opening and closing timing of at least one (1100, 1110) of an intake valve (1100) and an exhaust valve (1110), said variable valve timing apparatus including an actuator (2060) operating with a torque that is larger for a larger command value so as to operate said variable valve timing apparatus, said control method comprising the steps of:

controlling said command value in a first control mode;

controlling said command value in a second control mode in a manner that allows said command value to be larger than said command value controlled in said first control mode; and selecting said first control mode when said opening and closing timing is in a first region, and selecting said second control mode when said opening and closing timing is in a second region different from said first region.

11. The control method of controlling the variable valve timing apparatus according to claim 10, wherein said second region is advanced relative to said first region.

12. The control method of controlling the variable valve timing apparatus according to claim 10, wherein said first control mode is feedback control mode, and said second control mode is feedback control mode.

13. The control method of controlling the variable valve timing apparatus according to claim 10, wherein said first control mode is feed-forward control mode, and said second control mode is feed-forward control mode.

14. The control method of controlling the variable valve timing apparatus according to claim 10, wherein said first control mode is feed-forward control mode, and said second control mode is feedback control mode.

15. The control method of controlling the variable valve timing apparatus according to claim 10, wherein said first control mode is feedback control mode, and said second control mode is feed-forward control mode.

16. The control method of controlling the variable valve timing apparatus according to claim 10, wherein said variable valve timing apparatus further includes a driver unit (4002) driving said actuator (2060) so that said actuator (2060) operates with a larger torque as said command value is larger, and said command value is output to said driver unit (4002).

17. The control method of controlling the variable valve timing apparatus according to claim 10, wherein said command value is a voltage.

18. The control method of controlling the variable valve timing apparatus according to claim 10, wherein said command value is a current.

19. A variable valve timing apparatus changing opening and closing timing of at least one (1100, 1110) of an intake valve (1100) and an exhaust valve (1110), comprising:

an actuator (2060) operating with a torque that is larger for a larger command value so as to operate said variable valve timing apparatus;

first control means (4000) for controlling said command value;

second control means (4000) for controlling said command value in a manner that allows said command value to be larger than said command value controlled by said first control means (4000); and select means (4000) for selecting control by said first control means (4000) when said opening and closing timing is in a first region, and selecting control by said second control means (4000) when said opening and closing timing is in a second region different from said first region.

20. The variable valve timing apparatus according to claim 19, wherein said second region is advanced relative to said first region.

21. The variable valve timing apparatus according to claim 19, wherein said first control means (4000) includes means for controlling said command value in a feedback control mode, and said second control means (4000) includes means for controlling said command value in a feedback control mode.

22. The variable valve timing apparatus according to claim 19, wherein said first control means (4000) includes means for controlling said command value in a feed-forward control mode, and said second control means (4000) includes means for controlling said command value in a feed-forward control mode.

23. The variable valve timing apparatus according to claim 19, wherein said first control means (4000) includes means for controlling said command value in a feed-forward control mode, and said second control means (4000) includes means for controlling said command value in a feedback control mode.

24. The variable valve timing apparatus according to claim 19, wherein said first control means (4000) includes means for controlling said command value in a feedback control mode, and said second control means (4000) includes means for controlling said command value in a feed-forward control mode.

25. The variable valve timing apparatus according to claim 19, further comprising driver means (4002) for driving said actuator (2060) so that said actuator (2060) operates with a larger torque as said command value is larger, and said command value is output to said driver means (4002).

26. The variable valve timing apparatus according to claim 19, wherein said command value is a voltage.

27. The variable valve timing apparatus according to claim 19, wherein said command value is a current.

* * * * *

UNITED STATES PATENT AND TRADEMARK OFFICE

CERTIFICATE OF CORRECTION

PATENT NO. : 8,047,169 B2
APPLICATION NO. : 12/303341
DATED : November 1, 2011
INVENTOR(S) : Zenichiro Mashiki et al.

It is certified that error appears in the above-identified patent and that said Letters Patent is hereby corrected as shown below:

Title Page, Item (73) should read

-- (73) Assignee: Toyota Jidosha Kabushiki Kaisha,
Aichi-Ken (JP)

Denso Corporation
Aichi-Ken (JP) --

Item (56) Foreign Patent Documents, third item should read

-- (56) References Cited

FOREIGN PATENT DOCUMENTS

JP 11002142 A 1/1999 --

Signed and Sealed this
Twelfth Day of February, 2013

Teresa Stanek Rea
*Acting Director of the United States Patent and Trademark Office*